US006082363A

United States Patent [19]

Washburn

[11] Patent Number: 6,082,363

[45] Date of Patent: Jul. 4, 2000

[54] TRIPLE LAYER MOUTHGUARD HAVING INTEGRAL SHOCK ABSORBING FRAMEWORK

[75] Inventor: Steven J. Washburn, Minnetonka, Minn.

[73] Assignee: E-Z Gard Industries, Inc., Minnetonka, Minn.

[21] Appl. No.: 09/428,935

[22] Filed: Oct. 28, 1999

[51] Int. Cl.[7] ..... A61C 5/14

[52] U.S. Cl. ..... 128/859; 128/861; 128/862

[58] Field of Search ..... 128/846, 848, 128/859–862; 602/902; 433/6

[56] References Cited

U.S. PATENT DOCUMENTS

| | | | |
|---|---|---|---|
| 5,003,994 | 4/1991 | Cook | 128/848 |
| 5,031,638 | 7/1991 | Castaldi | 128/861 |
| 5,277,203 | 1/1994 | Hays | 128/861 |
| 5,339,832 | 8/1994 | Kittelson et al. | 128/862 |
| 5,415,544 | 5/1995 | Oxman et al. | 433/48 |
| 5,584,687 | 12/1996 | Sullivan et al. | 433/6 |
| 5,718,575 | 2/1998 | Cross, III | 433/6 |
| 5,746,221 | 5/1998 | Jones et al. | 128/859 |
| 5,826,581 | 10/1998 | Yoshida | 128/859 |
| 5,836,761 | 11/1998 | Belvedere et al. | 433/6 |
| 5,865,619 | 2/1999 | Cross, III et al. | 433/6 |
| 5,879,155 | 3/1999 | Kittelsen | 433/6 |

*Primary Examiner*—Michael A. Brown
*Attorney, Agent, or Firm*—Schwegman, Lundberg, Woessner & Kluth, P.A.

[57] ABSTRACT

A triple layer mouthguard apparatus has a U-shaped mouthguard base with an elastomeric frame embedded therein. The frame includes a wave-shaped contact surface. The mouthguard base includes inner and outer side walls defining an upper channel which has a liner disposed therein. The liner is adapted to form around the teeth when softened. The liner engages the teeth of the upper jaw and is made of a material that softens at a temperature lower than the material of the mouthguard base and becomes softer than the material of the mouthguard base when hardened.

16 Claims, 4 Drawing Sheets

TRIPLE LAYER MOUTHGUARD HAVING INTEGRAL SHOCK ABSORBING FRAMEWORK

FIELD OF THE INVENTION

The present invention relates generally to protective mouthguards for use by athletes, and more particularly to a mouthguard that absorbs, attenuates and dissipates shock forces exerted on the mouthguard with additional teeth, jaw and joint protecting features.

BACKGROUND OF THE INVENTION

Mouthguards can protect the teeth and reduce the chance of shock, concussions and other injuries resulting from high impact collisions and blows during athletic competition. Failure to use a mouthguard or the use of an improperly fitted mouthguard when impacts, collisions or blows occur to the jaw structure of an athlete can result in athletes' susceptibility to headaches, earaches, ringing in the ears, clogged cars, vertigo, concussions and dizziness. Different types of mouthguards are available including nonpersonalized, universal and stock model type, or are custom formed to the teeth of an individual user. However, in the past, personalized and/or properly fitted mouthguards required the services of a dentist or other type of skilled practitioner, which added significantly to the cost of the mouthguard, potentially resulting in an athlete omitting use of the properly fitted mouthguard.

Other types of mouthguards are available which do not require the services of a dentist or skilled practitioner, and can be self-fitted. Many self fitting devices fail to provide accurately fitting devices or sufficient protection to the jaw during athletic activity. In one example, a dental appliance has pad sections for posterior teeth which are coupled together with a narrow band or wire. Some examples of this type of dental appliance include U.S. Pat. No. 5,879,155 issued Mar. 9, 1999, U.S. Pat. No. 5,836,761 issued Nov. 17, 1998, and U.S. Pat. No. 5,718,575 issued Feb. 17, 1998. Another dental appliance is described in U.S. Pat. No. 5,865,619, which issued Feb. 2, 1999 and relates to a dental appliance having posterior pads coupled together by an arch. However, for each of the above, there is little or no protection provided to the anterior teeth and therefore may not be suitable for athletic activities where a player may experience force to the front of the mouth, as there would be insufficient protection.

Other mouthguards provide protection for the anterior teeth and/or posterior teeth, where some have provided layers of more than one material in an attempt to assist with the self-fitting process. For instance, U.S. Pat. No. 5,031,638 issued Jul. 16, 1991, relates to a mouthguard having multiple layers of material where the first layer and the third layer have the same properties, where the first layer fills the mouthguard prior to the fitting process. However, one drawback is that the first layer of material is displaced out of the mouthguard as the mouthguard is fitted to the teeth. Another example is a two-layer mouthguard shown in U.S. Pat. No. 5,339,832 issued Aug. 23, 1994 which has a mouthguard with a frame embedded therein. A further example is a mouthguard shown in U.S. Pat. No. 5,865,619, which issued Feb. 2, 1999 and relates to a dental appliance having posterior pads coupled together by an arch. However, as mentioned above, this dental appliance does not provide significant protection to the anterior teeth rendering it unsuitable for providing protection during certain activities.

In another example, a mouthguard includes three layers of material, including a first mouthguard layer, a second layer, and a top layer, where the top layer is harder than the first mouthguard layer when hardened during the fitting process, and the top layer is formed of a polymer including caprolactone. However, users of the device often chew the mouthguard between uses, resulting in the deterioration and crumbling of the top layer, and a looser fitting of the mouthguard during subsequent uses. Furthermore, the caprolactone shrinks during the hardening process, resulting in user discomfort as the user inserts the mouthguard into place.

Accordingly, what is needed is a mouthguard which is easy to use such that it can be fitted without the assistance of a dentist or a physician. What is also needed is a mouthguard which absorbs and dissipates shock forces exerted on the mouthguard during athletic activity, and yet does not deteriorate during use. What is further needed is a mouthguard which protects anterior teeth during athletic activity.

SUMMARY OF THE INVENTION

A triple layer mouthguard apparatus has a mouthguard base having a U-shape with inner and outer side walls extending upward from the base. The inner and outer side walls form an upper channel therein. A shock absorbing frame is embedded in the mouthguard base to absorb, attenuate and dissipate shock forces exerted on the mouthguard during athletic activity. A liner is disposed in the upper channel of the base and is adapted to engage the teeth of the upper jaw. The liner is made of a material that softens at a temperature lower than the material of the mouthguard base and becomes softer than the material of the mouthguard base when hardened.

Advantageously, the triple layer mouthguard permits the formation of a customized thermoplastic mouthguard base protecting the teeth, jaws and gums. The elastomeric framework further absorbs, attenuates and dissipates shock forces exerted on the mouthguard. The thermoplastic liner softens at a lower temperature than the mouthguard base and flows better to give a better fit of the mouthguard, without having excess fitting material displaced into the user's mouth during the fitting process. A further benefit is that the frame acts as an anterior impact brace on the anterior portion of the mouthguard contacting the anterior teeth, and which extends through the mouthguard forming cushioning pads in the molars and the occlusal regions for the posterior teeth to absorb, attenuate and dissipate shock. Furthermore, the wave shape of the frame provides for absorption, attenuation and dissipation of shock.

Another advantage of the present invention is that the liner, which is softened at a lower temperature than the mouthguard base, flows better than harder EVA and provides a closer fit to all of the contours of the teeth than harder EVA. This makes it less likely that the mouthguard will fall out of the mouth and also makes it less likely that the wearer will chew the mouthguard excessively. This also allows the mouthguard to be manufactured in fewer sizes because the fit is more accurate. Because the liner is softened at a lower temperature than the harder material of the mouthguard base, the mouthguard base is not significantly affected, and yet allows the liner to be fitted to the teeth. Yet another benefit of the liner is that the liner does not squirt out of the mouthguard when being fitted to the teeth. Furthermore, the mouthguard apparatus is longer such that is covers the posterior teeth of the upper jaw up to including the third molar, which has a better retention to the teeth when worn.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

BRIEF DESCRIPTION OF THE DRAWINGS

Figure 1:
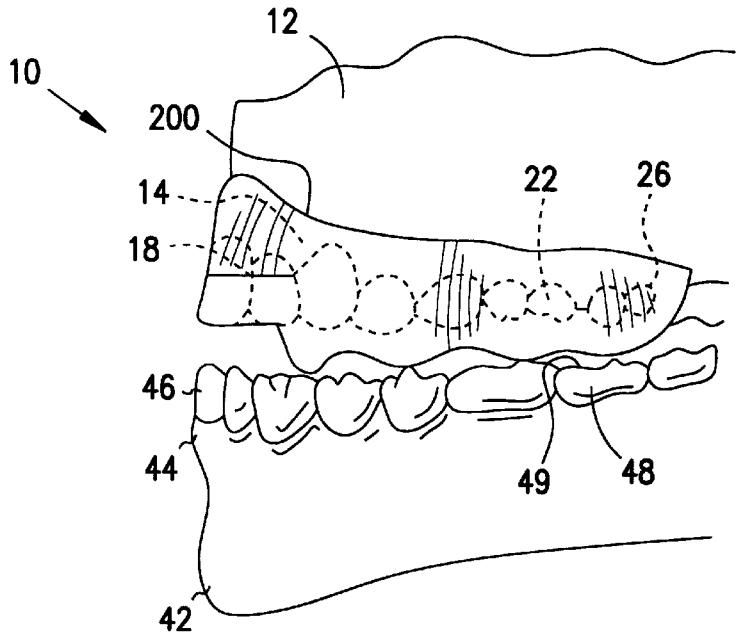
Figure 2:
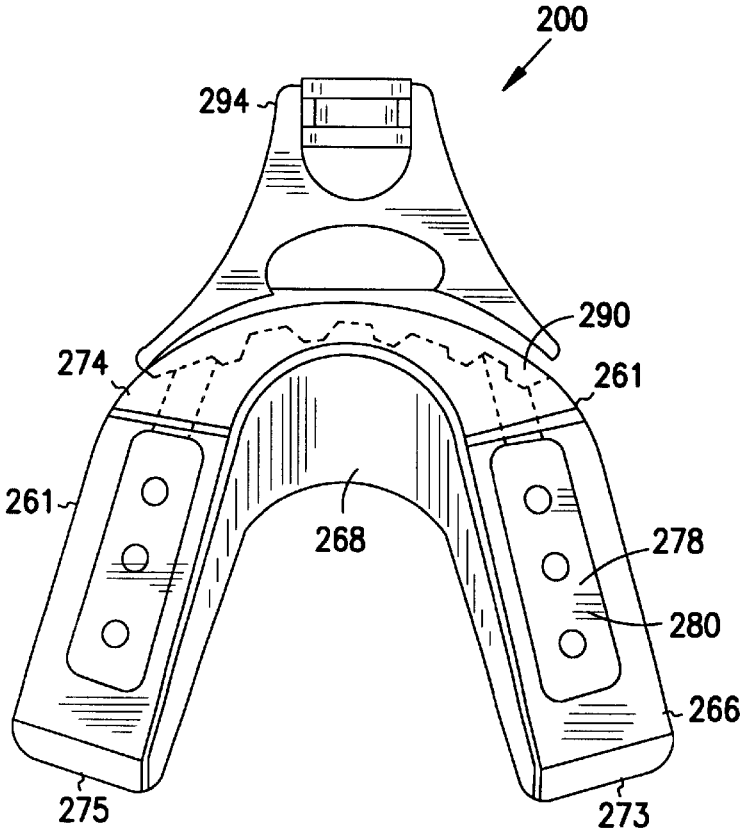
Figure 3A:
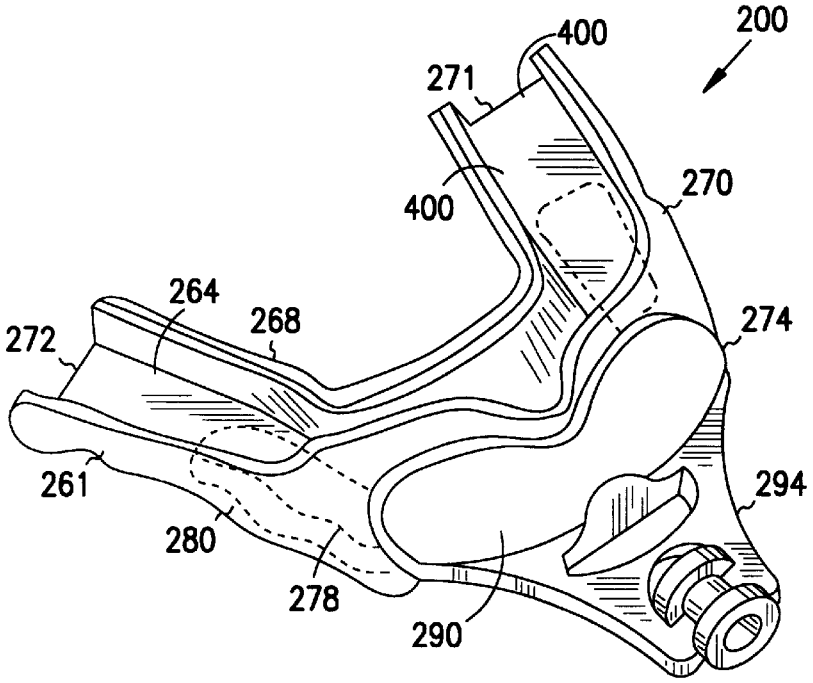
Figure 3B:
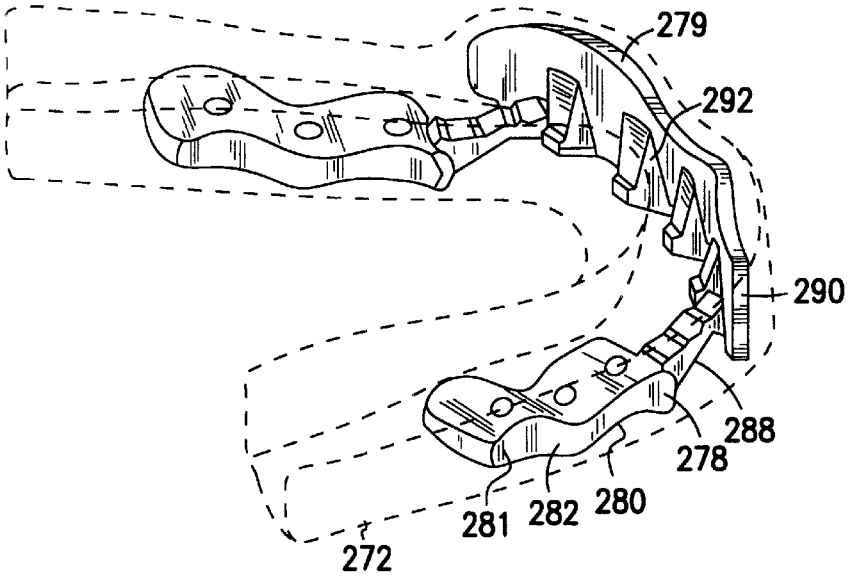
Figure 4:
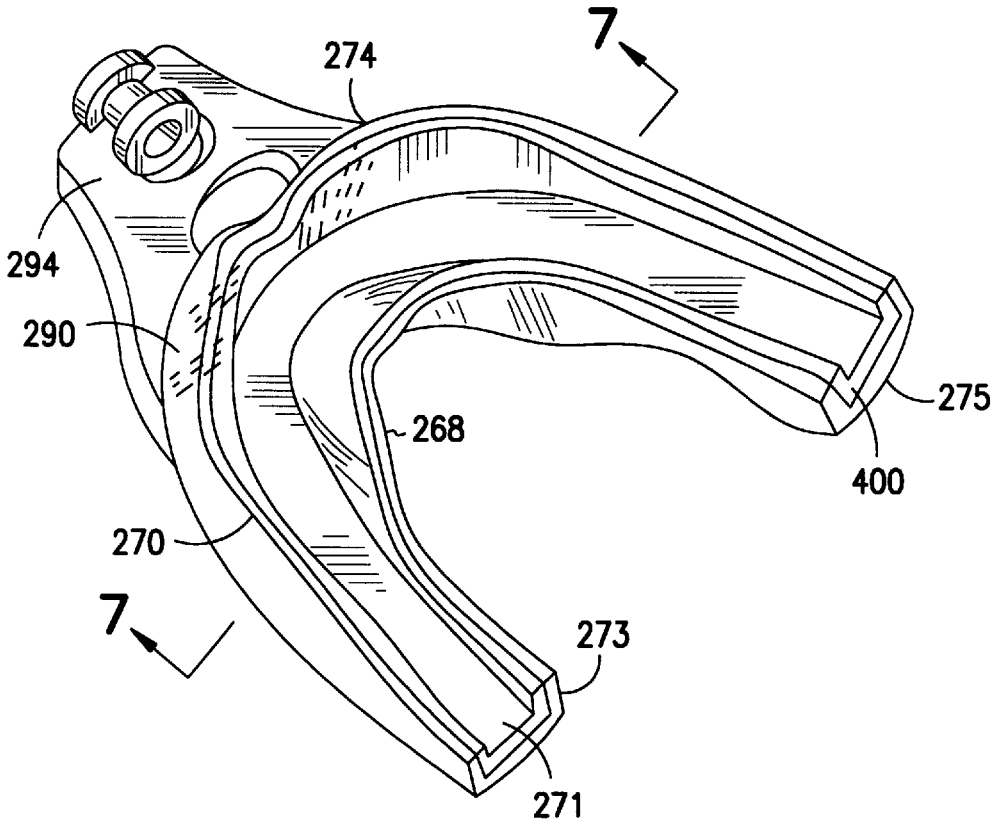
Figure 5:
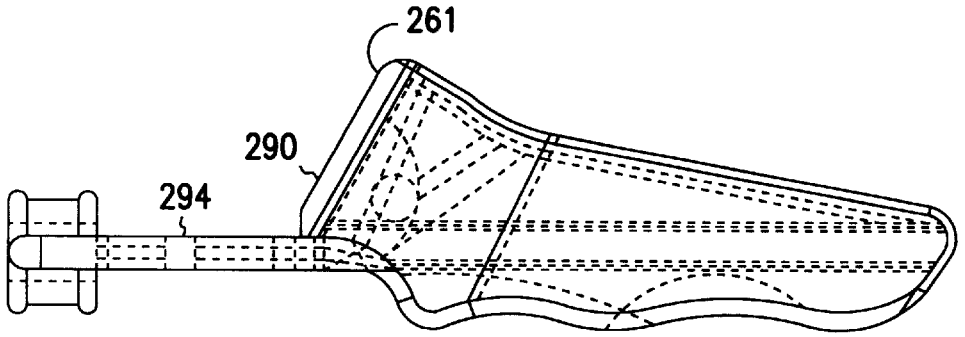
Figure 6:
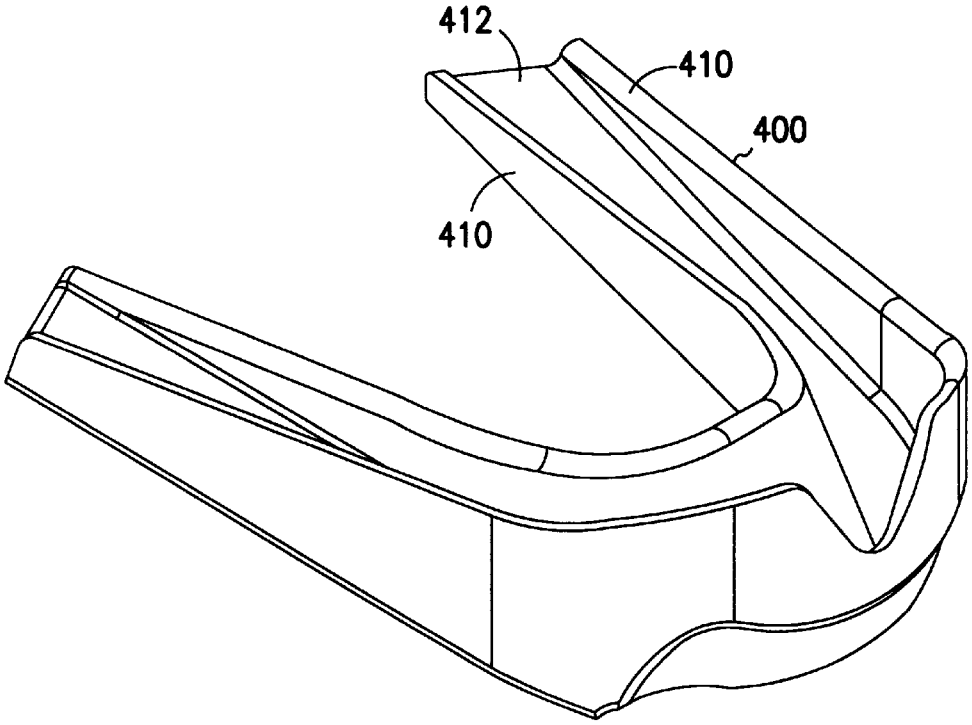
Figure 7:
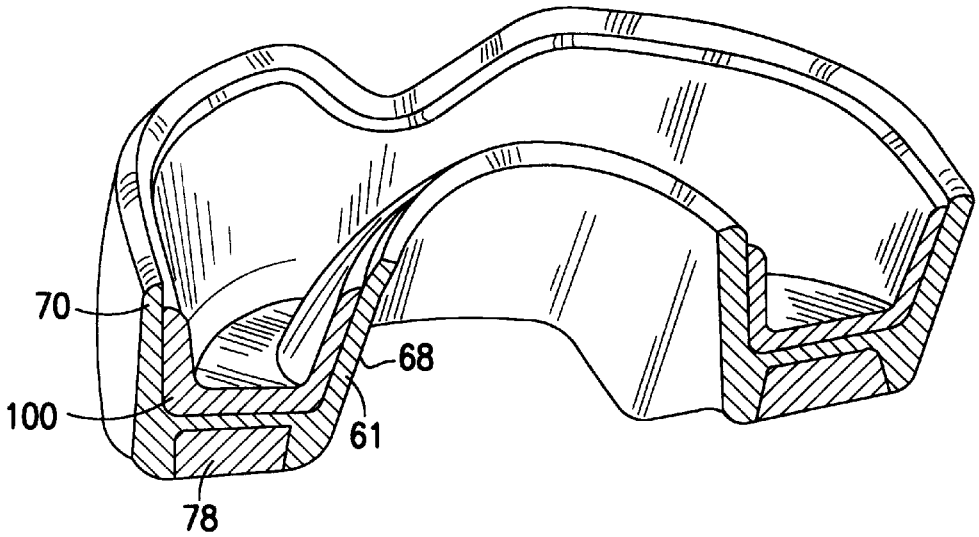

| | |
|---|---|
| FIG. 1 | is a partial side elevational view of jaws and mouth joint of a user including a mouthguard apparatus constructed in accordance with one embodiment of the present invention; |
| FIG. 2 | is a bottom plan view of the mouthguard apparatus constructed in accordance with one embodiment of the present invention; |
| FIG. 3A | is a perspective view of the mouthguard apparatus illustrating a base of the elastomeric frame in phantom outline; |
| FIG. 3B | is a perspective view of the mouthguard apparatus illustrating the elastomeric frame and the anterior cushion pads with the mouthguard base shown in phantom; |
| FIG. 4 | is a top perspective view of the mouthguard apparatus constructed in accordance with one embodiment of the present invention; |
| FIG. 5 | is a side elevational view of the mouthguard apparatus constructed in accordance with one embodiment of the present invention; |
| FIG. 6 | is a perspective view of the liner for the mouthguard apparatus constructed in accordance with one embodiment of the present invention; and |
| FIG. 7 | is a cross-section of the mouthguard apparatus taken along the lines 7—7 of FIG. 4. |

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

A mouthguard apparatus 200 is provided which permits the formation of a customized thermoplastic mouthguard base protecting the teeth, jaws and gums. To understand the structural features and benefits of the mouthguard apparatus 200, the environment in which the mouthguard apparatus is used will first be described. Referring to FIG. 1, a mouthguard user would have a mouth 10, generally including a rigid upper jaw 12 and a movable lower jaw 42 which are movably coupled at a temporomandibular joint (TMJ).

The rigid upper jaw 12 has gum tissue 14 within mouth 10. Gum tissue 14, as well as the bone thereunder, support anterior teeth (incisors and canines) 18 which have incisal or biting surfaces. The gum tissue 14 and the bone thereunder also support posterior teeth (molars and bicuspids) 22 which have cusps and biting surfaces 26. The movable lower jaw 42 supports a bone covered by gum tissue 44 which further supports anterior teeth (incisors and canines) 46 and posterior teeth (molars and bicuspids) 48 with occlusal surfaces 49.

The mouthguard apparatus 200 is shown in more detail in FIGS. 2–7. The mouthguard apparatus 200 is comprised of a thermoplastic mouthguard base 261, which is generally U-shaped, with an embedded elastomeric frame 278, and a liner 400, as further described below.

The thermoplastic mouthguard base 261 is U-shaped with a top side 264 and a bottom side 266. Extending upward on the top side 264 are inner and outer side walls 268 and 270 forming an upper channel 271 therebetween for receiving the upper jaw and teeth 12, 18 and 22 (FIG. 1). The mouthguard base 261 has an anterior portion 274 and a posterior portion 272, terminating at ends 273, 275. The side walls 268 and 270, in one embodiment, have a uniform thickness as they extend upward from the top side 264 of the U-shaped mouthguard base 261. This minimizes any tendency of the walls 268 and 270 to sag together and bond during the fitting process. In another embodiment, the side walls 268, 270 and the upper channel 271 therein extend to the ends 273, 275. As the ends 273, 275 of the mouthguard base 261 cover the third molar, this provides additional protection to the teeth and jaw of a user.

The mouthguard base 261 is made of a first material of a softenable thermoplastic. The first material, in one embodiment, comprises copolymers of ethylene and vinyl acetate, such as ethylene vinyl acetate (EVA). In another embodiment, the mouthguard base 261 is formed of a first material which is a copolymer having vinyl acetate in the range of 18% to 25% by weight. A commercial copolymer suitable for use is Elvax® resin marketed by the GP Division of Ashland Chemical Co. Elvax® Resin 350 through 450 has the desired proportions of vinyl acetate. In one embodiment, Elvax® 450 is used, which has 18% by weight vinyl acetate.

Referring to FIG. 3B, the frame 278 is formed within the mouthguard base 261, where the frame 278 is defined in part by an anterior portion 279 and a posterior portion 281. The frame 278 includes posterior cushion pads 280 at the posterior portion 281 and an anterior impact brace 290 at the anterior portion 279. The posterior cushion pads 280 lay proximate to the posterior portions 272 of the U-shaped base 261. In one embodiment, the posterior cushion pads 280 do not extend to the ends 273, 275 of the base 261. The posterior cushion pads 280 assure proper fitting of the mouthguard apparatus 200 when softened by prohibiting the mouthguard user from biting too deeply into the first material of the mouthguard base 261.

In one embodiment, the cushion pads 280 have a wave shape. The wave shape of the cushion pads 280 comprises cushioning springs 282 which are adapted to absorb impact force by flattening and rebounding to the curvilinear shape after the impact force is removed. Thus, the impact force is first absorbed by the springs 282, and then further absorbed by deformation of the pads 280. In another embodiment, as shown in FIG. 2, the cushion pads 280 extend through the mouthguard base 261 to contact the lower teeth at a contact surface.

Referring again to FIG. 3B, a transition support portion 288 extends between the posterior cushion pads 280 and connects to an anterior impact brace 290. As shown in FIG. 3A, the anterior impact brace 290 has anterior cushion pads 292 which are embedded in the anterior portion 274 to support the anterior teeth 18 (FIG. 1) of the upper jaw 12 (FIG. 1) to advantageously absorb, attenuate and dissipate shock. The mouthguard base 261 surrounds the anterior cushion pads 292 to embed the frame 278 in the anterior portion 274 of the mouthguard base 261. In one embodiment, a tether tab 294 (FIGS. 3A and 4) is coupled with the mouthguard base 261 and may be used for connecting the mouthguard apparatus 200 to a tether.

The elastomeric frame 278 is made of a second material of a non-softening, resilient, low compression elastomer, which unlike copolymers of ethylene and vinyl acetate, exhibits a high resilience, low compression, shape maintenance and shock absorption, attenuation and dissipation. Virtually all rubbers that exhibit these physical characteristics may be used for the elastomeric frame 278, including vulcanized rubber.

In one embodiment, the second material is a composite of a copolymer of ethylene and vinyl acetate, such as the Elvax® resins discussed above, and an elastomeric material selected from the group consisting of thermoplastic rubber and vulcanized rubber. In one embodiment, the second material is comprised of 50% to 80% by weight of the elastomeric material and 20% to 50% by weight of the copolymer of ethylene and vinyl acetate. In yet another embodiment, the copolymer comprises vinyl acetate in the range of 18% to 28% by weight. Alternatively, the copolymer comprises about 25% vinyl acetate.

One example of a suitable second material is thermoplastic rubber marketed under the trademark KRATON®, which is marketed by GLS Plastics of 740B Industrial Drive, Cary, Ill. 60013. This thermoplastic rubber is unique in that it is injection moldable, FDA approved and readily adheres with copolymers of ethylene and vinyl acetate. Furthermore, the thermoplastic rubber has a melting or softening point significantly higher than that of EVA. Consequently, the elastomeric frame 278 is initially molded or formed after which the thermoplastic mouthguard base 261 may be injection molded therearound.

As illustrated in FIGS. 3A and 4, the mouthguard apparatus 200 includes a liner 400 molded to the top side 264 of the U-shaped base 261 and to the inner side wall 268 and outer side wall 270. The liner 400 has a receiving channel 402 therein which is adapted to engage the teeth of the upper jaw (FIG. 1). The liner 400, in one embodiment, has a constant thickness which is slightly thinner than the inner side wall 268 and outer side wall 270 of the mouthguard base 261. For instance, the thickness of the liner 400 will be about 0.040 inches and the thickness of the walls 68 and 70 will be about 0.060 inches. In yet another embodiment, as shown in FIG. 6, the liner 400 is defined by side walls 410 and a bottom wall 412, and the bottom wall 412 is thicker than the liner side walls 410. In another embodiment, the liner 400 extends to the ends 273, 275 of the mouthguard base 261. Alternatively, the height of the liner 400 is less than the height of the walls 268 and 270, to further prevent the liner 400 from squirting out of the mouthguard base 261 during the fitting process.

The liner 400 is formed of a third material which softens at a temperature lower than the softening temperature of the first material and is softer than the first material when hardened. In one embodiment, the third material comprises 100% of a copolymer of ethylene and vinyl acetate, and has at least 33% of vinyl acetate by weight. In yet another embodiment, the third material comprises a copolymer of ethylene and vinyl acetate, and has at least 40% of vinyl acetate by weight. For example, a suitable third material is a soft EVA 40. Alternatively, another suitable third material comprises EVA 100.

Before use of a mouthguard apparatus 200, a user must fit the apparatus in their mouth. To fit the apparatus 200, the mouthguard apparatus 200 is momentarily submersed into boiling water for 16–60 seconds. This will cause the liner 400 to soften without appreciably softening the thermoplastic mouthguard base 261. Thereafter, the mouthguard apparatus 200 is immediately placed onto the teeth 18 and 22 of the upper jaw 12 (FIG. 1). The U-shaped base 261 will cover the posterior teeth of the upper jaw up, including the third molar. The user bites down firmly and applies suction between the upper jaw 12 and the mouthguard apparatus 200 while packing the mouthguard apparatus 200 with the hands along the cheeks and gums adjacent the anterior and posterior teeth 18 and 22 of the upper jaw 12 (FIG. 1). The posterior teeth 48 of the lower jaw 42 will properly index upon the bottom surface of the U-shaped base 261.

The third material of the thermoplastic liner 400 softens at a temperature of about 97 degrees Fahrenheit, and the first material of the mouthguard base 261 does not soften until about 142 degrees Fahrenheit. When the mouthguard apparatus is placed in the boiling water, the liner 400 will become softer than the mouthguard base 261. The liner 400 will easily conform to all of the contours of the teeth while the mouthguard base 261 is not appreciably deformed, except to conform somewhat to the outer dimensions of the teeth and gums. The fitting process causes displacement of the thermoplastic liner 400 around the individual teeth, allowing the liner to conform to the exact tooth shape, unlike standard mouthguards which only conform to the outside of the teeth. Since the third material is in the form of a liner 400 rather than filling the U-shaped base, the amount of third material that squirts out is kept to a minimum. As the mouthguard apparatus 200 cools, the liner 400 remains softer than the mouthguard base 261, retains the fit of the user's teeth and will not shrink. Because of this close fit, the mouthguard will be retained and the wearer will have less tendency to chew on it. Furthermore, as a user chews on the soft third material, the third material is less likely to crumble in a user's mouth.

The user of the triple layer mouthguard will have correct jaw posture for athletic participation which will assure minimal impact injury to the teeth and respective jaw. The elastomeric frame 278 with its component parts, especially the longitudinally curvilinear springs, will absorb, attenuate and dissipate shock forces as heretofore not known.

Advantageously, the triple layer mouthguard permits the formation of a customized thermoplastic mouthguard base protecting the teeth, jaws and gums. The elastomeric framework further absorbs, attenuates and dissipates shock forces exerted on the mouthguard. The thermoplastic liner softens at a lower temperature than the mouthguard base and flows better to give a better fit of the mouthguard, without having excess fitting material displaced into the user's mouth during the fitting process. A further benefit is that the frame acts as an anterior impact brace on the anterior portion of the mouthguard contacting the anterior teeth, and which extends through the mouthguard forming cushioning pads in the molars and the occlusal regions for the posterior teeth to absorb, attenuate and dissipate shock. Furthermore, the wave shape of the frame provides for absorption, attenuation and dissipation of shock.

Another advantage of the present invention is that the liner, which is softened at a lower temperature than the mouthguard base, flows better than harder EVA and provides a closer fit to all of the contours of the teeth than harder EVA. This makes it less likely that the mouthguard will fall out of the mouth and also makes it less likely that the wearer will chew the mouthguard excessively. This also allows the mouthguard to be manufactured in fewer sizes because the fit is more accurate, as the fit of the mouthguard is more of a volume fit than a dimensional one. Because the liner is softened at a lower temperature than the harder material of the mouthguard base, the mouthguard base is not significantly affected, and yet allows the liner to be fitted to the teeth. Yet another benefit of the liner is that the liner does not squirt out of the mouthguard when being fitted to the teeth. Furthermore, the mouthguard apparatus is longer such that is covers the posterior teeth of the upper jaw up to and including the third molar, which has a better retention to the teeth when worn.

It is to be understood that the above description is intended to bc illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A mouthguard apparatus comprising:

a mouthguard base having a general U-shape, the mouthguard base formed of a first material, the mouthguard base defined in part by a top surface and a bottom surface, the top surface having inner and outer side walls forming an upper channel therein;

an elastomeric frame formed within the mouthguard base, the frame defined in part by an anterior portion and a posterior portion, the frame formed of a second material, the frame including an impact brace near the anterior portion and cushion pads near the posterior portion;

a liner disposed in the upper channel of the mouthguard base, the liner forming a receiving channel to receive teeth therein, the liner formed of a third material; and the third material having a softening temperature lower than a softening temperature of the first material, the third material being softer than the first material when the third material is hardened.

2. The mouthguard apparatus as recited in claim 1, wherein the first material and the third material are made from a thermoplastic comprised of copolymers of ethylene and vinyl acetate.

3. The mouthguard apparatus as recited in claim 2, wherein the third material is a copolymer having a weight percentage of vinyl acetate of at least 33%.

4. The mouthguard apparatus as recited in claim 3, wherein the third material is a copolymer having a weight percentage of vinyl acetate of approximately 40%.

5. The mouthguard apparatus as recited in claim 1, wherein the first material comprises EVA 40.

6. The mouthguard apparatus as recited in claim 1, wherein the first material comprises EVA 100.

7. The mouthguard apparatus as recited in claim 1, wherein the liner is defined by side walls and a bottom wall, and the bottom wall is thicker than the side walls.

8. The mouthguard apparatus as recited in claim 1, wherein the mouthguard base has mouthguard side walls, and the liner has liner side walls, and the liner side walls are substantially the same as the mouthguard side walls.

9. The mouthguard apparatus as recited in claim 1, wherein the cushion pads of the frame have a wave-shape.

10. The mouthguard apparatus as recited in claim 1, wherein the mouthguard base has mouthguard side walls, where a depth of the receiving channel is substantially the same as a height of the mouthguard side walls.

11. The mouthguard apparatus as recited in 1, wherein the liner has liner side walls and the mouthguard base has mouthguard side walls, the liner side walls are shorter than the mouthguard side walls.

12. The mouthguard apparatus as recited in claim 1, wherein the frame forms a contact surface for lower teeth.

13. The mouthguard apparatus as recited in claim 12, wherein the contact surface is curvilinear.

14. A mouthguard apparatus comprising:

a mouthguard base having a general U-shape, the mouthguard base formed of a first material, the mouthguard base defined in part by a top surface and a bottom surface, the top surface forming an upper channel;

an elastomeric frame formed within the mouthguard base, the frame defined in part by an anterior portion and a posterior portion, the frame formed of a second material, the frame including an impact brace near the anterior portion and cushion pads near the posterior portion, the frame forming a contact surface for lower teeth and the contact surface is curvilinear;

a liner disposed in the upper channel of the mouthguard base, the liner forming a receiving channel to receive teeth therein, the liner formed of a third material, the liner defined by side walls and a bottom wall, and the bottom wall is thicker than the side walls, the liner having a general U-shape conforming to the mouthguard base;

the third material having a softening temperature lower than a softening temperature of the first material and being softer than the first material when the third material is hardened; and the first material and the third material are made from a thermoplastic comprised of copolymers of ethylene and vinyl acetate, and the third material is a copolymer having a weight percentage of vinyl acetate greater than 33%.

15. The mouthguard apparatus as recited in claim 14, wherein the first material comprises EVA 40.

16. The mouthguard apparatus as recited in claim 14, wherein the first material comprises EVA 100.

* * * * *